US006213178B1

(12) United States Patent
Jonkka et al.

(10) Patent No.: US 6,213,178 B1
(45) Date of Patent: Apr. 10, 2001

(54) METHOD AND APPARATUS FOR HANDLING LOGS TO BE DEBARKED

(75) Inventors: Arvo Jonkka; Kari Liljeroos; Tero Aronen, all of Pori (FI)

(73) Assignee: Valmet Woodhandling Oy (FI)

( * ) Notice: Subject to any disclaimer, the term of this patent is extended or adjusted under 35 U.S.C. 154(b) by 0 days.

(21) Appl. No.: 09/446,658

(22) PCT Filed: Jun. 15, 1998

(86) PCT No.: PCT/FI98/00513

§ 371 Date: May 5, 2000

§ 102(e) Date: May 5, 2000

(87) PCT Pub. No.: WO99/00231

PCT Pub. Date: Jan. 7, 1999

(30) Foreign Application Priority Data

Jun. 25, 1997 (FI) ..... 972740
Feb. 2, 1998 (FI) ..... 980226

(51) Int. Cl.[7] ..... B27L 1/08
(52) U.S. Cl. ..... 144/341; 144/208.1
(58) Field of Search ..... 144/208.1, 208.3, 144/208.9, 340, 341

(56) References Cited

U.S. PATENT DOCUMENTS 1,889,046 11/1932 Foss ..... 144/208.9
2,647,548 * 8/1953 Guettler ..... 144/208.9
4,180,109 12/1979 Heikkinen ..... 144/208.3
4,685,498 8/1987 Nakajima et al. ..... 144/208.9
5,263,522 * 11/1993 Sasko ..... 144/208.9
5,630,453 5/1997 Ishizawa ..... 144/208.9
5,699,843 * 12/1997 Gagne ..... 144/208.9

FOREIGN PATENT DOCUMENTS 29866 5/1958 (FI) .
321370 11/1929 (GB) .
1025613 * 6/1958 (NO) ..... 144/208.9

* cited by examiner

*Primary Examiner*—W. Donald Bray
(74) *Attorney, Agent, or Firm*—Lerner, David, Littenberg, Krumholz & Mentlik, LLP

(57) ABSTRACT

Methods are disclosed for removing the bark from logs including transporting the logs in a longitudinal direction, cutting the surface of the logs as they move in the longitudinal direction using blades projecting upwardly with respect to a bottom surface on which the logs are supported and which is moving transversely under the logs, and simultaneously causing the logs to move so that the logs alternately contact the blades and are displaced from contact with the blades. Apparatus for removing the bark from logs is also disclosed.

14 Claims, 7 Drawing Sheets

METHOD AND APPARATUS FOR HANDLING LOGS TO BE DEBARKED

FIELD OF THE INVENTION

The present invention relates to methods and apparatus for handling logs to be debarked.

BACKGROUND OF THE INVENTION

In the pulp and paper industry, logs are generally debarked before chipping. With some of logs which are to be used as raw material, the bark adheres very tightly to the logs or the bark is easily loosened as larger pieces, so that normal drum debarking is not fast enough, or in some cases discharging of the bark creates a problem. Particularly in connection with many tropical wood species, such as acacia and eucalyptus, the drum debarking method becomes problematic, as the long barks create problems by forming "bark balls" in the drum. The bark of acacia and eucalyptus also tends to loosen as long strips, so that the fresh bark also requires pretreatment, in order to avoid problems after contact with the drum. The long waste barks are not easily discharged through the bark slots of the drum and tend to come out along with the logs to the feeding conveyor of the chipper. In some cases, the drum debarking has also proven to be inefficient for the debarking of birch.

Other methods than drum debarking are used for debarking logs. A disadvantage of those methods is, however, their small capacity, which thus requires several debarking lines and a great number of devices. One known method of this kind is described in U.S. Pat. No. 4,685,498 of Fuji Kogyo. In this patent, the logs are transported through a channel-formed section in the longitudinal direction. On the bottom of the trough-shaped section, there are rollers disposed in longitudinal direction. When the rollers rotate, their teeth rasp the bark from the surface of the log.

In addition, debarking devices equipped with moving bottom elements have been tested. It has been shown in tests that a debarking apparatus shown in accordance with patent Finnish Patent No. 29866 does not rotate the logs efficiently enough, because the push force of the feed motion of the moving elements transferring the logs is not sufficiently stronger than the corresponding force in the reverse motion.

Periodically operating pretreatment devices are also being developed, the biggest disadvantage thereof being the constant need for supervision.

One such method is to break the surface of the bark with a high-pressure water jet. In such a procedure, however, a further method is also required in order to finally remove the bark. A known log pretreatment method of this type has been described in U.S. Pat. No. 4,180,109. In order to achieve the required water pressure, a strong pump is needed in this method. In addition, there are extreme requirements for the purity of the water so utilized.

SUMMARY OF THE INVENTION

In accordance with the present invention, these and other objects have now been realized by the invention of a method for removing the bark from logs comprising transporting the logs in a longitudinal direction, cutting the surface of the logs as they move in the longitudinal direction by means of blades projecting upwardly with respect to a bottom surface on which the logs are supported and which is moving in a transverse direction under the logs, and simultaneously causing the logs to move so that the logs alternately contact the blades and are displaced from contact with the blades. In a preferred embodiment, the method includes moving the blades in the transverse direction under the logs by swinging the bottom surface back and forth in the transverse direction.

In accordance with one embodiment of the method of the present invention, causing the logs to move comprises alternately contacting the logs with the blades and displacing the logs from the blades by alternately moving the blades from a location above the bottom surface to a location below the bottom surface. In a preferred embodiment, the method includes moving the logs in a first transverse direction when the blades are at a location above the bottom surface and rolling the logs in a second transverse direction opposite to the first transverse direction when the blades are at a location below the bottom surface.

In accordance with another embodiment of the method of the present invention, causing the logs to move comprises alternately contacting the logs with the blades and displacing the logs from the blades by providing an elevated portion projecting from the bottom surface, and comprising the elevated portion causing the logs to move in a first transverse direction when the logs are in contact with the blades and carrying the logs on the elevated portion in a second transverse direction opposite to the first transverse direction when the logs are displaced from contact with the blades.

In accordance with the present invention, apparatus has also been provided for removing the bark from logs comprising transporting means for transporting the logs in a longitudinal direction, a bottom surface for supporting the logs, and blade means projecting upwardly with respect to the bottom surface in a transverse direction for cutting the surface of the logs as they move in the longitudinal direction, the bottom surface including a bottom surface portion, the blade means disposed at a level below the bottom surface portion for at least some of the time that the apparatus is being operated. In a preferred embodiment, the bottom surface is movable back and forth in the transverse direction.

In accordance with one embodiment of the apparatus of the present invention, the bottom surface is inclined at a predetermined angle in the transverse direction, the bottom surface including a first end and a second end, the first end being higher than the second end, and including movable transverse beams carrying the blade means, whereby when the movable transverse beams are moving toward the first end of the bottom surface, the blade means are disposed at a level above the bottom surface, and when the movable transverse beams are moving toward the second end of the bottom surface, the blade means are disposed at the level below the bottom surface. In a preferred embodiment, the blade means include a substantially perpendicular edge facing the first end of the bottom surface thereby providing a pushing surface for moving the logs.

In accordance with another embodiment of the apparatus of the present invention, the apparatus includes an elevated surface movable with the bottom surface, the elevated surface being displaced above the blade means. In a preferred embodiment, the apparatus includes a plurality of stationary surfaces displaced longitudinally along the bottom surface and alternately projecting from below the elevated surface in a first transverse direction and a second transverse direction opposite the first transverse direction as the elevated surface moves back and forth in the transverse direction.

In accordance with one embodiment of the apparatus of the present invention, the apparatus includes at least one stationary longitudinal wall dividing the apparatus into at least two parallel sections.

In accordance with another embodiment of the apparatus of the present invention, the apparatus includes moving means for moving the bottom surface back and forth in the transverse direction, the moving means including a synchronizing shaft disposed in the longitudinal direction, crank means attached to the synchronizing shaft, and link means connecting the crank means to the bottom surface. In a preferred embodiment, the apparatus includes a stationary frame, and support means attached to the synchronizing shaft and link members connecting the support means to the stationary frame, whereby motion of the synchronizing shaft in the longitudinal direction is prevented.

In accordance with the method of the present invention, the debarking blades and the logs are moved in relation to each other, so that part of the time the logs are above the cutting edges of the blades, out of contact with the blades, and part of the time the logs are in contact with the cutting edges of the blades. The blades can be moved and the logs rotated in the transverse direction of the logs back and forth by means of members carrying logs periodically or by means of a stepped bottom. In accordance with the apparatus of the present invention, in the bottom there is one or more members carrying the logs, these members being from time to time or all the time higher up than the cutting edges of the blades. The blades are attached to the bottom of the apparatus, the bottom moving back and forth in the transverse direction of the apparatus, and carrying and pushing the logs periodically, or to members that form portions of the bottom.

As the logs are, for a portion of the time, higher up than the blades and out of contact with the blades, they are, during that time, able to move forward in the apparatus without bumping against the blades.

The apparatus in accordance with the present invention is continuously working and operates with a high capacity as a pretreatment device for logs to be debarked, and with a low capacity the apparatus can be used for debarking logs. The most important advantages of the present apparatus are efficient operation of the pretreatment or the debarking members and the controllability of the handling process.

In the method in accordance with the present invention, the logs to be pretreated move along with the bottom inclined in the longitudinal direction towards the moving direction, effected by the back and forth motion of the pretreatment member or the pretreatment members.

In the apparatus in accordance with the present invention, the pretreatment device comprises an inclined trough-formed frame and a trough-formed bottom moving back and forth in the transverse direction or pretreatment members moving back and forth in the transverse direction.

BRIEF DESCRIPTION OF THE DRAWINGS

The present invention may be more fully appreciated with reference to the following detailed description, which, in turn, refers to the drawings, in which.

DETAILED DESCRIPTION

Figure 1:
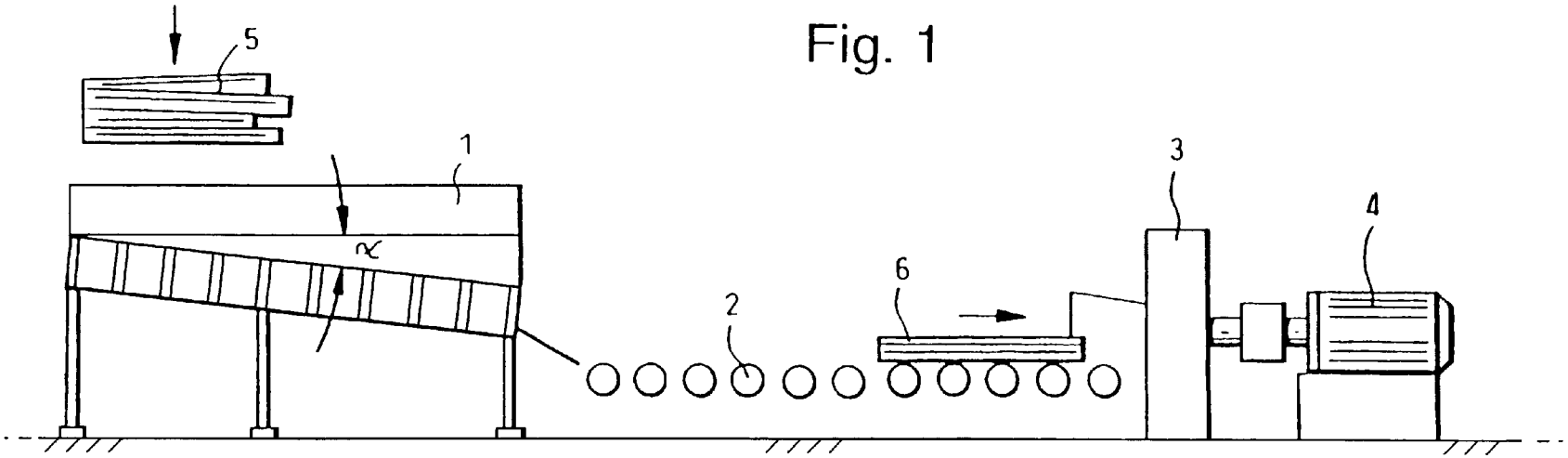
FIG. 1 is a side, elevational, partially schematic view of a line of debarking equipment in which the lines are debarked by means of the apparatus of the present invention.

Referring to the Figures, in which like reference numerals refer to like elements thereof, FIG. 1 shows a debarking line having a low capacity, in which log bundles 5 are loaded into a debarking apparatus I in accordance with the present invention and transferred by means of debarking members and a longitudinal angle of inclination a of the apparatus 1 towards a roller conveyor 2. The log bundles 5 break up during the debarking and the logs drop one by one or in small groups onto the roller conveyor 2 which feeds the logs 6 to a chipper 3 rotated by a motor 4.

Figure 2:
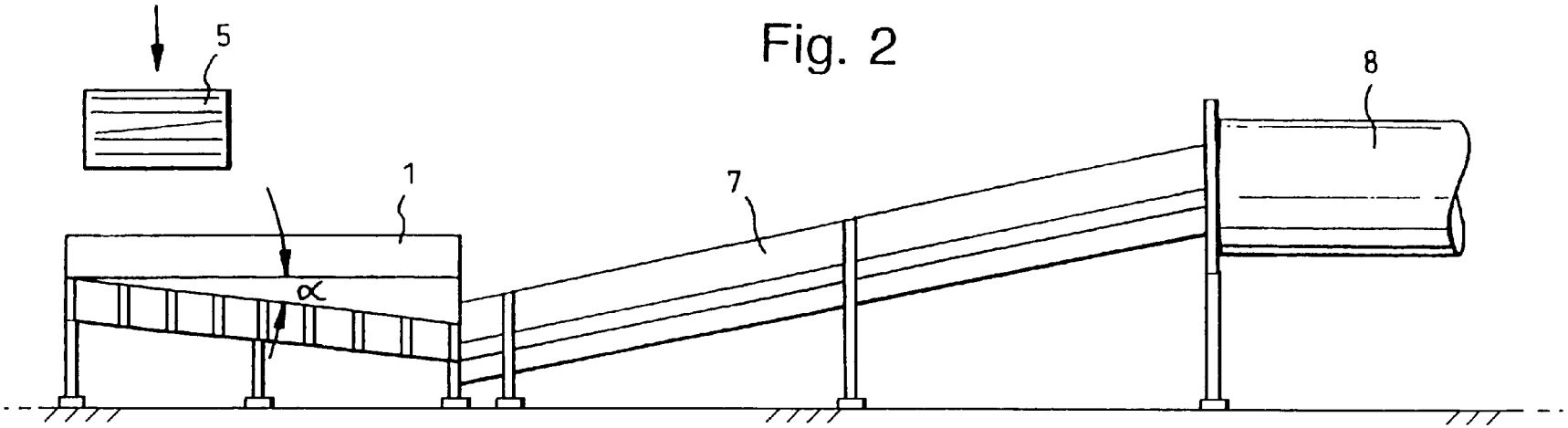
FIG. 2 is a side, elevational, partially schematic view of another line of debarking equipment in which the lines are pretreated for debarking by means of apparatus in accordance with the present invention.

FIG. 2 shows a debarking line having a high capacity, by which the debarking is effected after the pretreatment in a drum 8, into which the logs are fed by means of a conveyor 7. When handling logs that are difficult to debark, such as acacia or eucalyptus, the bark must be cut into lengths, in order to be discharged through the bark slots of the debarking drum 8.

The bark is cut by means of a pretreatment apparatus 1, onto which the log bundles 5 are loaded by means of a crane or a log truck. The pretreatment apparatus 1 is equipped with debarking members that cut the bark into certain lengths due to the rotating of the logs and the sliding motion resulting from the angle of inclination $\alpha$ of the apparatus 1. The direction of the cutting movement of the blades is parallel to the direction of the cutting edge of the blades.

Figure 3:
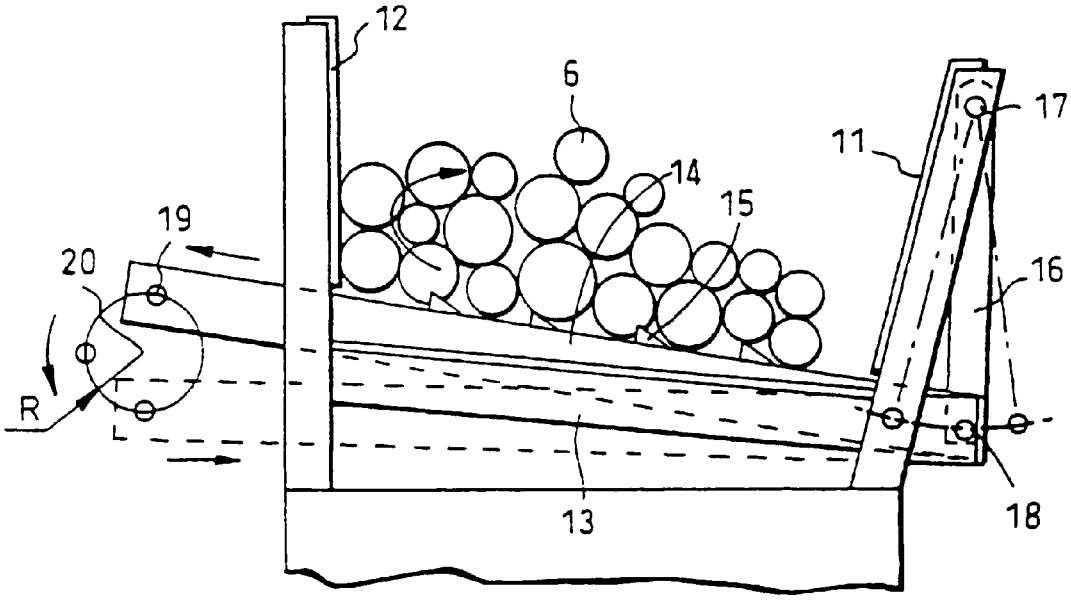
FIG. 3 is a front end, elevational view of another embodiment of apparatus in accordance with the present invention.
Figure 4:
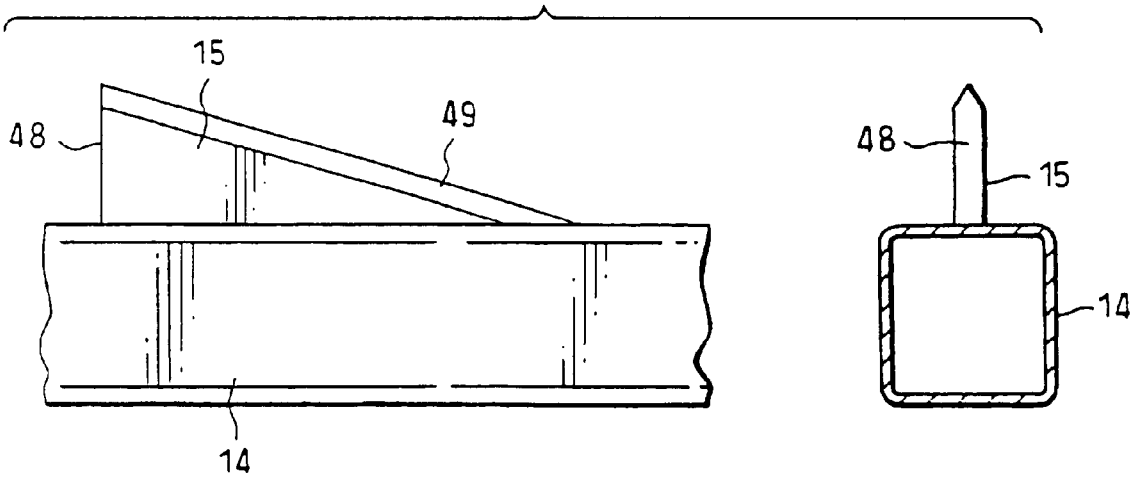
FIG. 4 is a partial side, elevational view and a front or sectional view of a transfer member for logs in accordance with the apparatus of the present invention.
Figure 5:
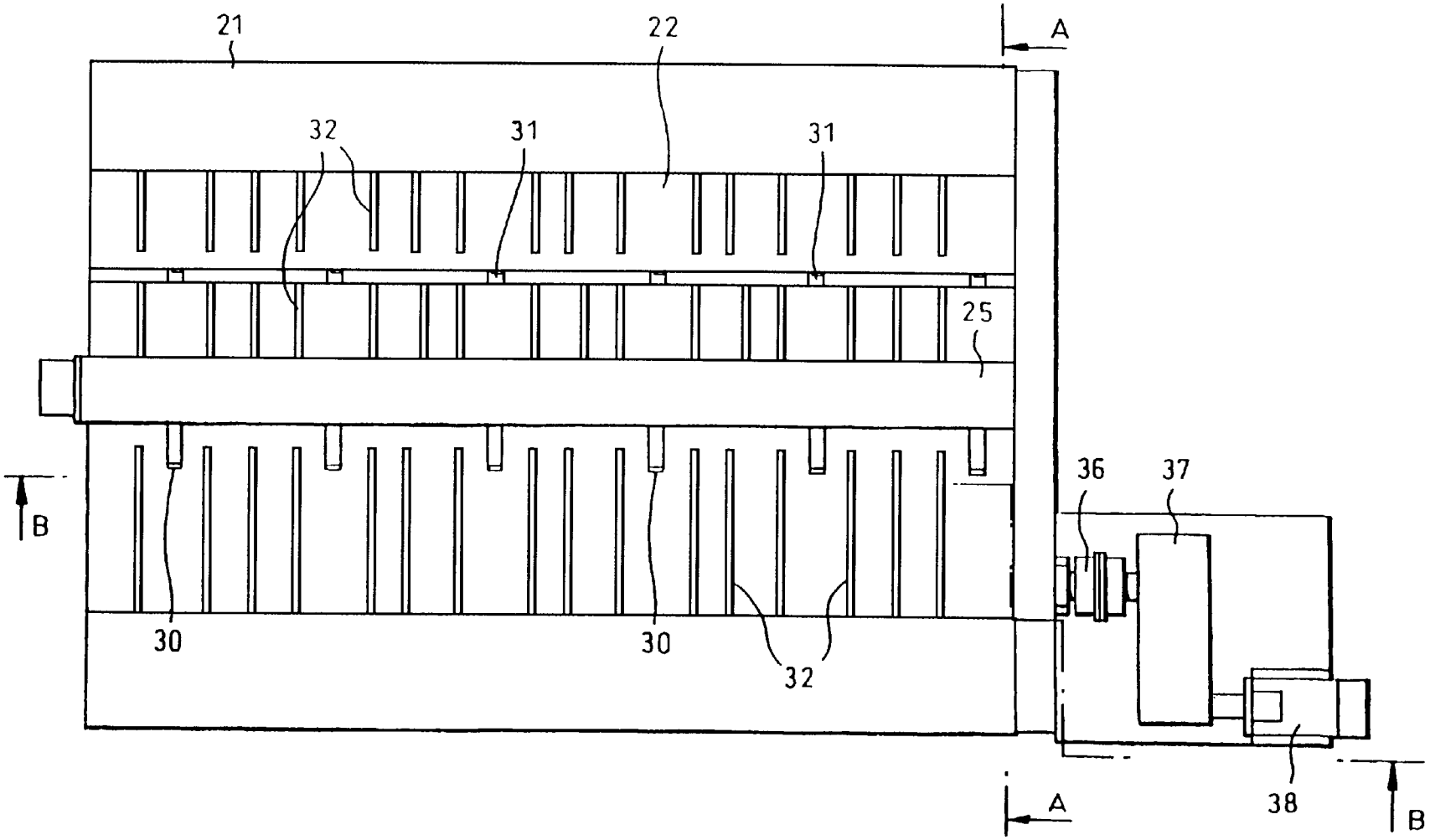
FIG. 5 is a top, elevational view of apparatus in accordance with the present invention with an integral bottom.

FIG. 3 shows the construction of an apparatus 1 in accordance with the present invention, whereby the log bundle to be handled "lives" or rotates efficiently. The apparatus comprises stationary sides, 11 and 12, and between them a set of bottom beams 13. Between the bottom beams 13 there are arranged movable handling beams 14, into which members 15 for transferring logs are attached, these members also cutting the bark surface of the logs. The handling beams are supported at one end by means of rocking arms 16. The supporting of the other end is arranged by a crankshaft 20 described schematically in the figure, the crankshaft rotating the handling beams 14 through a link 19, so that the handling beams carry the logs and transfer them by means of the transfer members, in other words, teeth 15 "uphill", and the beams 14 make their reverse motion below the bottom beams 13, so that the beams 14 and the teeth 15 do not draw the logs backwards. Both the bottom beams and the handling beams have been supported so that the one end equipped with the crankshaft 20 is higher than the other end. Thus, the bottom is inclined sideways. Due to this inclination, the logs on the surface roll towards the other, lower side. The teeth 15 of the handling beams 14 are formed so that when the beams move towards the higher side 12 of the bottom, the front edges 48 of the teeth transfer the logs to be handled towards that side (FIGS. 3 and 4). The reverse motion of the teeth is arranged along a lower path so that their less inclined, sharp-edged, cutting rear side 49 does not meet the logs until closer to the lower side 11. The motion of the beams 14 is controlled by the positions of the joint pins, 17 and 18, and the operation radius R of the link 19 of the crankshaft 20. The motions of the apparatus and the log bundle 5 are indicated by arrows in FIG. 3.

Figure 6:
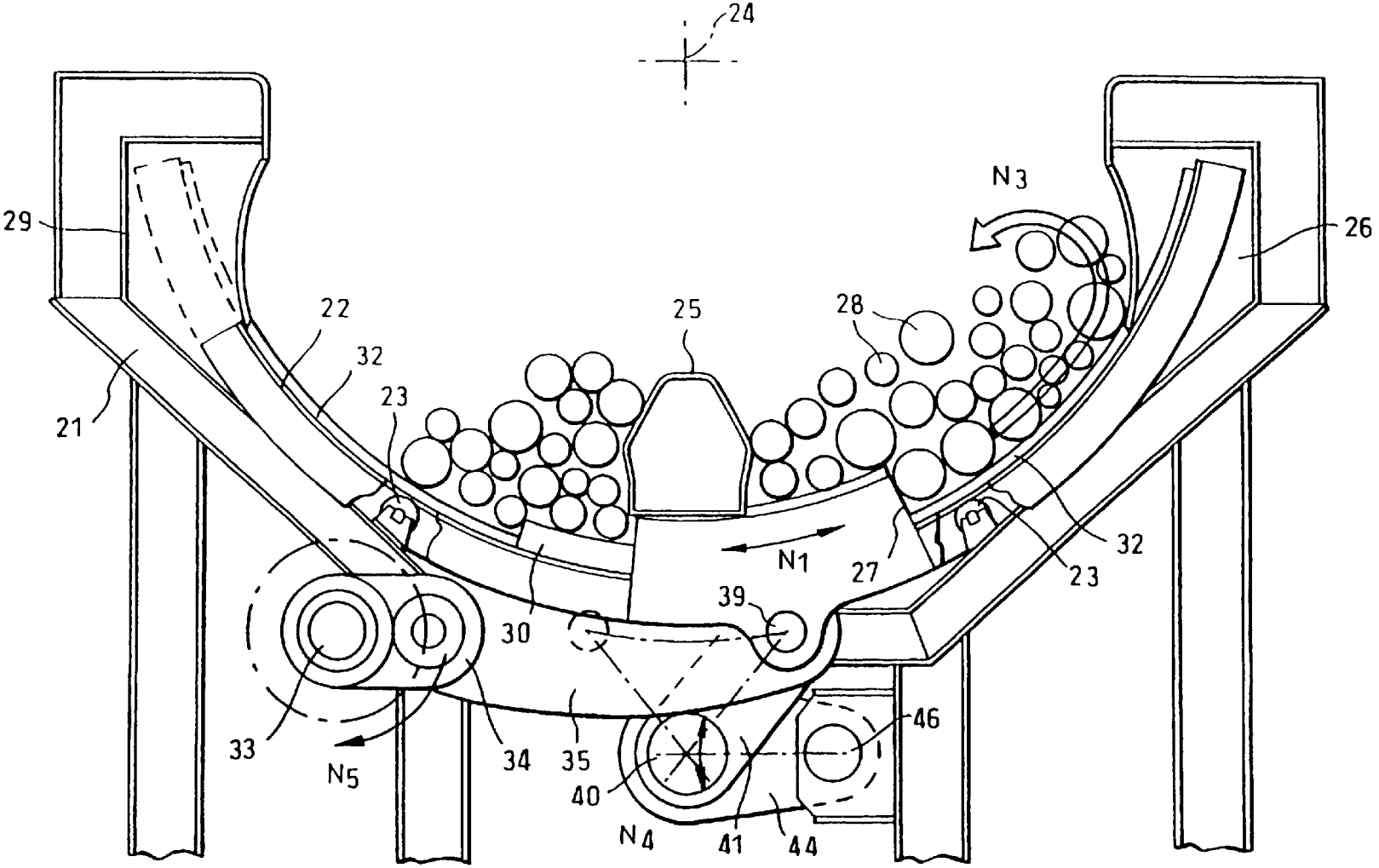
FIG. 6 is a front, elevational, sectional view taken along lines A—A of FIG. 4.
Figure 7:
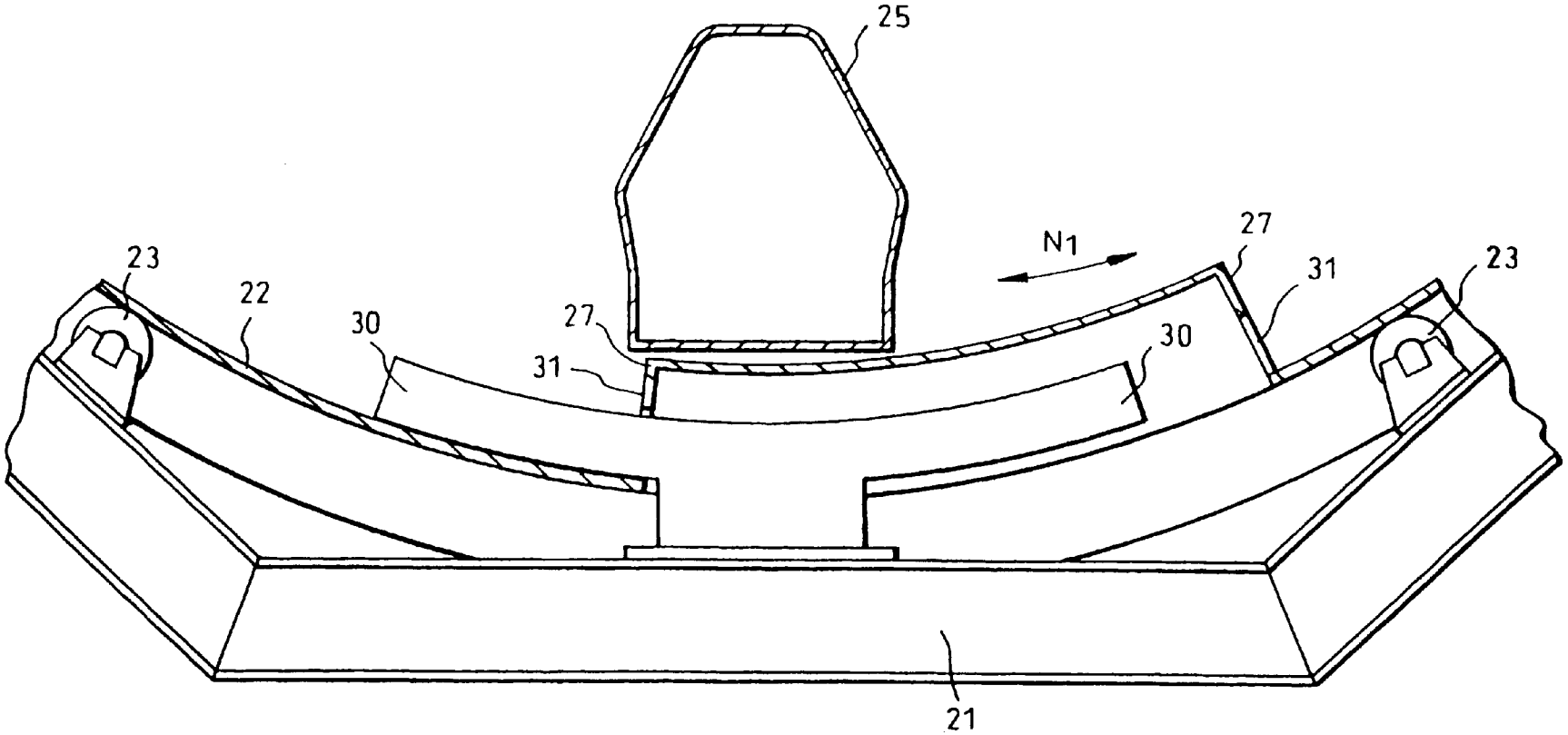
FIG. 7 is a front, partial, elevational, sectional view of a portion of the apparatus shown in FIG. 4.

FIGS. 5 to 9 show another construction in accordance with the present invention. This apparatus comprises a trough-formed frame 21 and an integral plate bottom 22 moving back and forth and formed as part of a cylinder, and provided with a stepped elevation 27. FIG. 6 shows how efficient motion of the logs can be accomplished by means of the stepped bottom. The bottom 22 is carried by supporting rollers 23 attached to the frame 21 (FIGS. 6 and 7). The cross-section of the bottom 22 has the form of a circular arc or essentially a circular arc. The back and forth motion of the bottom 22 indicated by arrow N, occurs around the center 24 of part of the cylinder. The bottom is divided into two parallel portions by a stationary longitudinal center bracket 25 supported on the frame 21 at the ends of the apparatus, thus not being in contact with the bottom 22.

The logs are divided into two separate piles by the center bracket 25 and the handling of the logs is effected on both side portions of the bottom. When the bottom moves to the other side 26 of the apparatus, the longitudinal stepped elevation 27 moving along with the bottom under the center bracket and arranged into the middle portion of the bottom, pushes the logs 28, situated longitudinally on the bottom of the trough upwards along the side, and the uppermost logs of the log pile roll, due to the cylindrical form of the bottom, towards the center bracket 25 as shown by the arrow N3. When the stepped elevation 27 moves under the center bracket, the logs on the other side of the center bracket fall onto the bottom 27 or on top of "pushers" 30. When the bottom moves to the opposite direction, towards the other side 29, the logs on the bottom of the trough tend to return along with the bottom towards the center bracket. The return is prevented by stationary "pushers" 30 and by the center bracket 25 (FIG. 7). The "pushers" are transverse stoppers arranged at certain longitudinal distances of the device from each other, projecting from below the center bracket to the two sides of the bracket. The "pushers" are lower than the elevation 27 of the bottom, and directly adjacent to them, on both sides of the elevation, there are openings 31, through which the stationary "pushers" come out from under the elevation when the elevation is moving back and forth along with the bottom.

Figure 8:
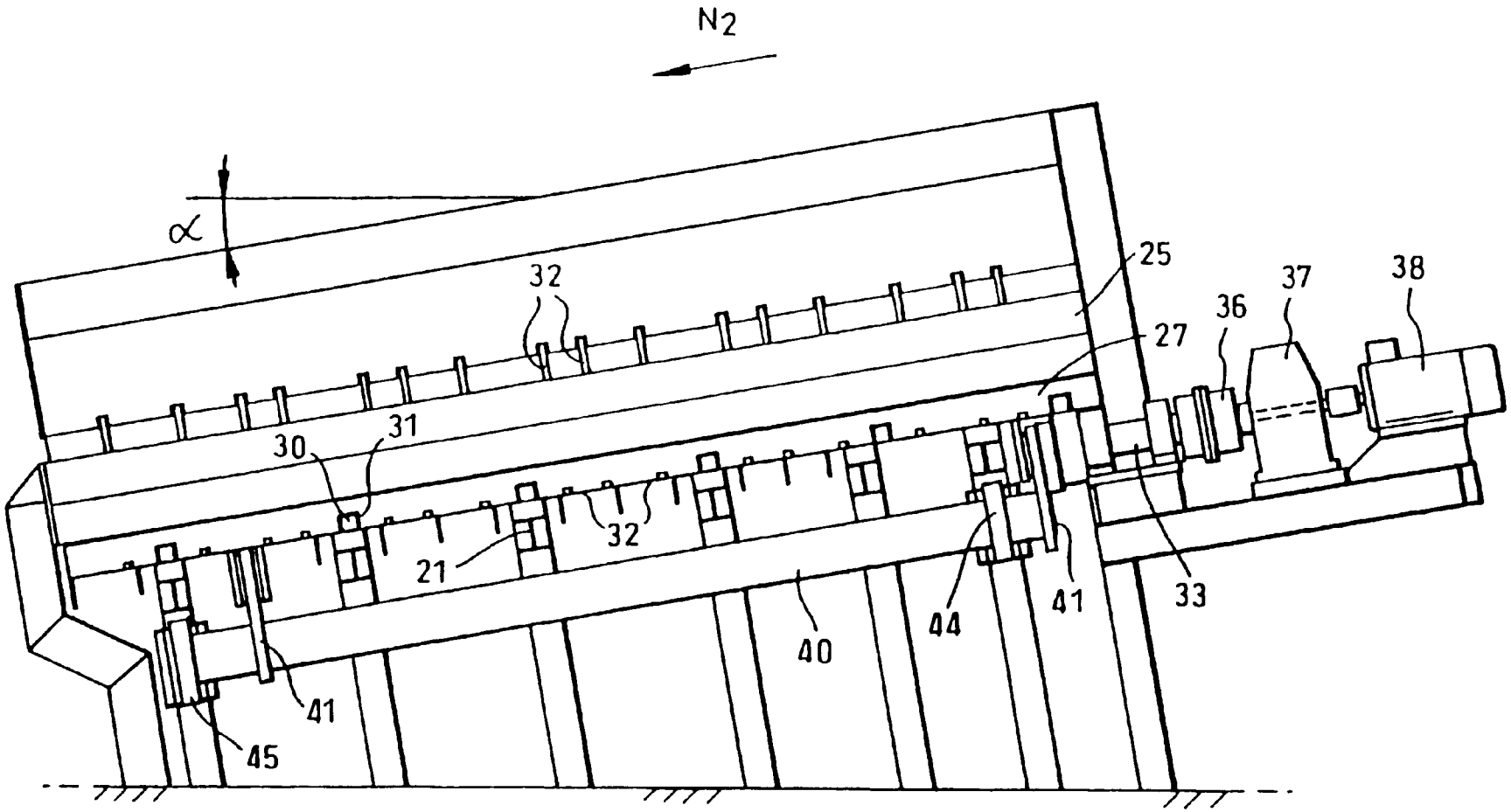
FIG. 8 is a front, elevational, partial view of the apparatus of FIG. 4 taken along section B—B thereof.
Figure 9:
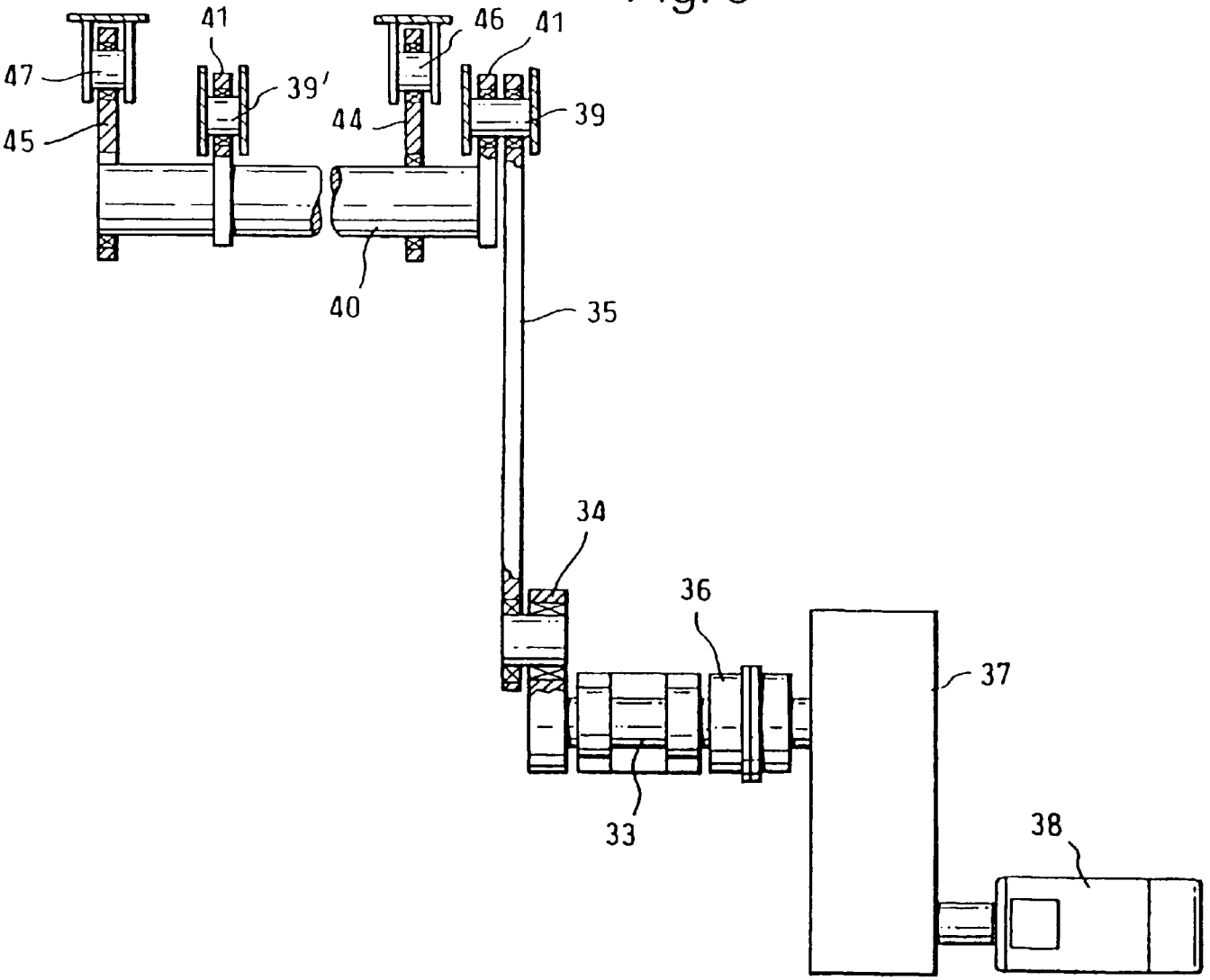
FIG. 9 is a top, elevational, partially sectional view of a drive mechanism for the apparatus shown in FIG. 4.

Attached to the bottom 22, there are, at certain longitudinal distances of the device from each other, transverse blades 32 (FIG. 6) for cutting the bark of the logs, and those blades, when moving back and forth with the bottom, cut the bark into lengths, as the "pushers" 30 and the center bracket 25 prevent the return motion of the log when the bottom 22 slides under the log pile to be handled. Due to the rolling of the log pile, all of the logs are at some stage in contact with the blades 32. Effected by the back and forth motion of the bottom and the cutting motion of the blades, the logs also roll around their own axis, so that the bark will be cut all over the log, Because of the living of the log pile and the angle of inclination $\alpha$ of the pretreatment apparatus, the direction of the forward motion of the logs follows the arrow N2 (FIG. 8). As the apparatus of FIGS. 4–8 can be constructed with an almost solid plate bottom, it has a considerable advantage, in that there is no need for any collecting means for loose bark and rubbish under the apparatus.

The back and forth motion of the bottom 22 is effected by the crank 34 of the crankshaft 33 and an articulated rod 35. The motion of the crank 34 is shown by arrow $N_5$. The crankshaft 33 is connected to a gearing 37 (FIG. 9) through a coupling device 36. The gearing is driven by an electric motor 38. One end of the articulated rod 35 is connected with a bearing to the bottom 22 through a link 39. The bottom is also connected through links, 39 and 39', to cranks 41 of a synchronizing shaft 40. The synchronizing shaft 40 prevents the bottom from twisting, so that both ends of the bottom remain synchronous. The synchronizing shaft 40, effected by the motion of the bottom 22, also moves vertically along a low gradient curve, supported by cranks, 41 and 41', and supports, 44 and 45, (arrow $N_4$). The supports, 44 and 45, prevent the synchronizing shaft 40 from moving in the direction of the horizontal radius of the shaft 40. The supports, 44 and 45, are supported with bearings at their one end to the synchronizing shaft 40 and at their other end to the frame 21 of the apparatus through links, 46 and 47.

Instead of the gearing 37 and the electric motor 38, a hydraulic motor can also be used.

In this connection, a sideways inclination means an inclination around the longitudinal axis of the apparatus and the longitudinal inclination means an inclination around the transversal axis of the apparatus.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the resent invention as defined by the appended claims.

What is claimed is:

1. A method for removing the bark from logs comprising transporting said logs in a longitudinal direction, cutting the surface of said logs as they move in said longitudinal direction by means of blades projecting upwardly with respect to a bottom surface on which said logs are supported and which is moving in a transverse direction under said logs, and simultaneously causing said logs to move so that said logs alternately contact said blades and are displaced from contact with said blades.

2. The method of claim 1 including moving said blades in said transverse direction under said logs by swinging said bottom surface back and forth in said transverse direction.

3. The method of claim 1 wherein said causing said logs to move comprises alternately contacting said logs with said blades and displacing said logs from said blades by alternately moving said blades from a location above said bottom surface to a location below said bottom surface.

4. The method of claim 3 including moving said logs in a first transverse direction when said blades are at a location above said bottom surface and rolling said logs in a second transverse direction opposite to said first transverse direction when said blades are at a location below said bottom surface.

5. The method of claim 1 wherein said causing said logs to move comprises alternately contacting said logs with said blades and displacing said logs from said blades by providing an elevated portion projecting from said bottom surface, and comprising said elevated portion causing said logs to move in a first transverse direction when said logs are in contact with said blades and carrying said logs on said elevated portion in a second transverse direction opposite to said first transverse direction when said logs are displaced from said contact with said blades.

6. Apparatus for removing the bark from logs comprising transporting means for transporting said logs in a longitudinal direction, a bottom surface for supporting said logs, and blade means projecting upwardly with respect to said bottom surface in a transverse direction for cutting the surface of said logs as they move in said longitudinal direction, said bottom surface including a bottom surface portion, said blade means disposed at a level below said bottom surface portion for at least some of the time that said apparatus is being operated.

7. The apparatus of claim 6 wherein said bottom surface is movable back and forth in said transverse direction.

8. The apparatus of claim 6 wherein said bottom surface is inclined at a predetermined angle in said transverse direction, said bottom surface including a first end and a second end, said first end being higher than said second end, and including movable transverse beams carrying said blade means, whereby when said movable transverse beams are moving toward said first end of said bottom surface, said blade means are disposed at a level above said bottom surface, and when said movable transverse beams are moving toward said second end of said bottom surface, said blade means are disposed at said level below said bottom surface.

9. The apparatus of claim 8 wherein said blade means include a substantially perpendicular edge facing said first end of said bottom surface thereby providing a pushing surface for moving said logs.

10. The apparatus of claim 7 including an elevated surface movable with said bottom surface, said elevated surface being displaced above said blade means.

11. The apparatus of claim 10 including a plurality of stationary surfaces displaced longitudinally along said bottom surface and alternately projecting from below said elevated surface in a first transverse direction and a second transverse direction opposite said first transverse direction as said elevated surface moves back and forth in said transverse direction.

12. The apparatus of claim 9 including at least one stationary longitudinal wall dividing said apparatus into at least two parallel sections.

13. The apparatus of claim 7 including moving means for moving said bottom surface back and forth in said transverse direction, said moving means including a synchronizing shaft disposed in said longitudinal direction, crank means attached to said synchronizing shaft, and link means connecting said crank means to said bottom surface.

14. The apparatus of claim 13 wherein said apparatus includes a stationary frame, and including support means attached to said synchronizing shaft and link members connecting said support means to said stationary frame, whereby motion of said synchronizing shaft in said longitudinal direction is prevented.

* * * * *